United States Patent [19]

Pierson et al.

[11] 3,975,556

[45] Aug. 17, 1976

[54] METHOD FOR PREVENTING COATING METAL PICKUP ON HOT-DIP COATING LINE ROLLS

[75] Inventors: Marvin B. Pierson, Franklin; Charles Flinchum, Trenton, both of Ohio

[73] Assignee: Armco Steel Corporation, Middletown, Ohio

[22] Filed: Sept. 19, 1973

[21] Appl. No.: 398,761

[52] U.S. Cl. ..... 427/122; 118/420; 118/620; 427/434

[51] Int. Cl.[2] ..... B05C 3/02

[58] Field of Search ..... 117/114 R, 93, 93.2, 117/DIG. 11, 226, 94, 5.3; 29/132; 106/2; 118/620, 420, 49.1; 427/122, 434, 433, 49, 362, 434 R

[56] References Cited

UNITED STATES PATENTS

| | | | |
|---|---|---|---|
| 982,385 | 7/1909 | Huxley | 118/420 |
| 2,115,127 | 4/1938 | Smith | 117/127 |
| 2,415,196 | 2/1947 | Steinberg | 117/DIG. 11 |
| 2,547,120 | 4/1951 | Herwig | 117/DIG. 11 |
| 3,058,840 | 10/1962 | Kerr et al. | 118/620 |
| 3,247,020 | 4/1966 | Shulver et al. | 427/122 |
| 3,307,968 | 3/1967 | Schnedler | 117/114 A |
| 3,396,935 | 8/1968 | Snyder | 117/5.3 |
| 3,502,493 | 3/1970 | Forestek | 117/31 |
| 3,549,392 | 12/1970 | Strauss et al. | 117/5.3 |
| 3,632,368 | 1/1972 | Nelson | 117/31 |
| 3,778,315 | 12/1973 | Booker et al. | 427/434 |

*Primary Examiner*—Ralph S. Kendall
*Assistant Examiner*—Edith R. Buffalow
*Attorney, Agent, or Firm*—Melville, Strasser, Foster & Hoffman

[57] ABSTRACT

Application of a graphite film to at least the first roll contacted by a metal strip to which a coating metal has been applied. The roll may be scraped clean and the graphite film applied immediately after scraping. The graphite film may be applied by wiping the roll with a solid graphite block or by wiping the roll with a graphite colloidal suspension in a suitable carrier. In the latter event, the roll temperature must be high enough to vaporize the carrier so that strip contamination is avoided. The graphite film prevents adherence of coating metal particles to the roll surface whereby damage to the coated surface on the metal strip is prevented.

14 Claims, 1 Drawing Figure

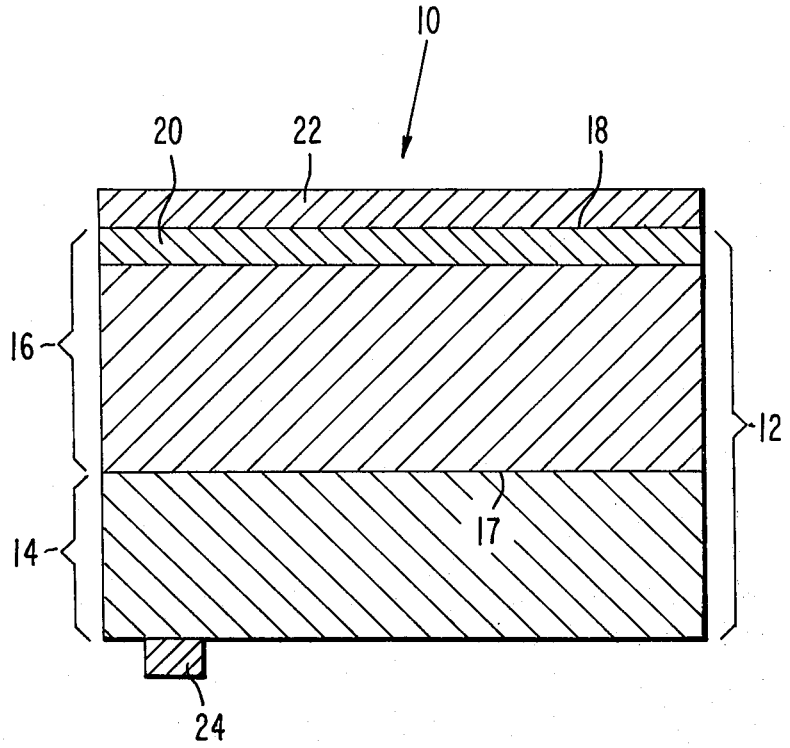
10
20
22
18
16
12
14
17
24

METHOD FOR PREVENTING COATING METAL PICKUP ON HOT-DIP COATING LINE ROLLS

BACKGROUND OF THE INVENTION

1. Field of the Invention

This invention has particular application to metal treating systems in which a coating metal is applied to a metal strip by the well known hot-dip process. An accepted method of treating a zinc coated steel strip, for example, is to utilize resistance heating after the strip leaves the zinc bath so as to effect complete alloying of the zinc and steel base to form a "galvanealed" type product. High strip temperatures at the point of first roll contact above the pot cause a severe roll pick-up hazard. Use of a graphite film on the first roll above the zinc pot prevents adherence of coating metal particles to the surface of such roll; this film also reduces friction between the strip and roll surface without disturbing electrical continuity between the strip and the roll for resistance heating.

2. Description of the Prior Art

No patentability search has been conducted to determine whether graphite films have been used in the manner contemplated by this invention. It is known, however, that when coating metal picks up on the roll surface to a certain point, the coated sheet is subjected to damage which may result in rejected material. It has been the practice in the past, therefore, to mechanically clean the roll from time to time by the use of wire brushes or by scraping. This, however, seems to result in more and more roll scraping being needed. Such frequent roll scrapings are inherently difficult and inconvenient. It has also been known to use internal water cooling of the roll to cut down pickup but this has resulted in strip distortion. Other coatings evaluated were either nonconductive or not effective. Thus, for example, tower rolls have been glass coated, ceramic coated, chromium coated or sprayed externally with water, all with but limited success.

SUMMARY OF THE INVENTION

A thin graphite coating may be applied to the roll surface by wiping it with, for example, a 10% graphite colloidal suspension in mineral oil when the roll is hot enough to vaporize the oil, leaving the adherent graphite film. The film prevents adherence of coating metal particles to the roll surface and reduces friction between the strip and roll surface without disturbing electrical continuity between the strip and the roll when resistance heating is practiced to effect the coating required. The roll temperature must be high enough to vaporize the mineral oil, or other carrier, so that strip contamination by sticky oil and the like is avoided. The graphite film application may also be achieved by wiping the roll surface with a solid graphite block.

BRIEF DESCRIPTION OF THE DRAWINGS

The single FIGURE of the drawings is a rather schematic depiction of the type of apparatus and system to which this invention has application.

DESCRIPTION OF THE PREFERRED EMBODIMENTS

With reference to the drawing, a typical system to which this invention may be applied is depicted. In this connection reference is made to the following United States Patents which disclose similar systems: Schnedler U.S. Pat. No. 2,986,808; Kerr et al U.S. Pat. No. 3,058,840 and Schnedler U.S. Pat. No. 3,307,968. Thus, there is shown at 10 a coating pot containing molten zinc indicated at 11. A strip 12, which has been subjected to any desired pretreatment, passes around a pot roll 13 within the pot 10 and thence upwardly past a submerged stabilizing roll 14. The freshly coated strip 12*a* then passes upwardly between air knives or the like, diagrammatically illustrated at 15, which determine the finished thickness of the coating applied whereafter the strip continues through heating means 16 and then about a turning roll 17. This turning roll 17 is the first roll encountered by the coated strip after it leaves the coating pot 10. This is the roll that will receive the treatment of this invention.

In the set-up shown, the electrical circuit consisting of strip 12*a*, top roll 17, bus bar 20, pot 10, and zinc bath 11 forms a low voltage, high current loop of a transformer with the other loop indicated as a coil 22 surrounding the strip. The roll 17 is made of material having good electrical conductivity, and has a slip ring 18 with which a brush 19 makes contact. It will be understood by those skilled in the art that the set-up thus described will, in conjunction with other suitable equipment not specifically shown, provide for resistance heating of the coated strip as it passes from the pot 10 around the contact roll 17.

In a conventional zinc coating operation, the strip may issue from the coating pot 10 at a temperature of about 850°F or so. The maximum rate of alloying of zinc and iron may occur at temperatures ranging from 900°F to 1025°F. As the strip comes out of the bath of molten zinc 11, the air knives 15 or the like employed to determine final thickness of the coat, and ambient conditions, have a cooling effect on the freshly coated strip. The burners 16, therefore, and the resistance heating of the strip as described in connection with the means 18–22, serve to get the strip to proper alloying temperature at the optimum time and to hold it there for the correct period. These procedures, however, are exemplary only. Whether resistance heating is used, or induction heating as is also well known in the art, or a combination of resistance heating and induction heating, the problem lies with coating pickup on the roll 17, the first roll above the pot 10. (This invention may have application to "aluminized" processes wherein the pickup problem may be more apt to occur on the second roll.)

When resistance heating is employed during the alloying step, electrical continuity becomes important. This accentuates the problem of metal pickup. As herein earlier indicated, the prior art has attempted to solve this problem by means including internal water cooling of the critical roll. Other means have also been attempted. Tower rolls like that shown at 17 have been glass coated, ceramic coated, chromium coated, and externally water cooled. The rolls have been cleaned mechanically by wire brushes or scraper blocks. All of these methods have proved either non-conductive or not effective.

In the preferred practice of this invention, a thin graphite coating is applied to the surface of the roll 17 by wiping it with a 10% graphite colloidal suspension in mineral oil when the roll is hot enough to vaporize the oil, whereby to leave the adherent graphite film. The film prevents adherence of coating metal particles to the roll surface and reduces friction between the strip and roll surface without disturbing electrical continuity between the strip and the roll, particularly when resistance heating is practiced as a part of the alloying operation.

It has also been found that the graphite application may be satisfactorily achieved by wiping the surface of roll 17 with a solid graphite block wiper. Additionally, a graphite-water suspension may be employed.

Apparently the thickness of the graphite coating is not critical; the important thing is to have some residual graphite covering the roll. The graphite film thickness is simply that which is enough to prevent adherence and, as indicated, this may be achieved in the manners described. So long as the surface of the roll 17 is covered with a graphite film, the objects of the invention are achieved.

In practice, operating benefits have been considerable and maintenance frequency has been greatly reduced. By way of example, on one coating line the frequency of roll cleaning has been extended from once every eight hours to once every 72 hours. When it does become necessary to recondition the roll surface, as is required only infrequently with the practice of this invention, an effective practice is to scrape the roll clean and then treat the roll with the graphitic oil immediately after scraping. In this manner the frequent, difficult roll scrapings required by the prior art are much reduced. The graphite film is an effective electrically conductive coating. The graphite treatment is inexpensive, easy to apply and one that doesn't have to be renewed nearly so frequently as prior coatings employed by the prior art.

The amount of rejected alloyed strip, formerly too frequently encountered when coating metal adhered to the roll surface to a certain point, has been materially reduced, along with reduced maintenance frequency requirements, by the practice of this invention. The graphite film is effective, there is no problem of strip contamination, and the film is quite durable and long lasting.

Although this invention has been described largely in connection with the alloying of zinc coatings on metal bodies, it is not to be limited thereto. The graphite treatment may be used for other coating systems such as regular galvanize or aluminize. In any event, in those instances wherein the graphite film is applied by application of a graphite colloidal suspension in a suitable carrier, the roll temperature must be high enough to vaporize the carrier, otherwise strip contamination by the sticky remains of the carrier could result. The 10% graphite colloidal suspension in mineral oil has been found quite effective.

It should be understood that while this invention has been described in connection with particular materials, methods and apparatus, such are not to constitute a limitation on this invention except insofar as they are specifically set forth in the subjoined claims.

The embodiments of the invention in which an exclusive property or privilege is claimed are defined as follows:

1. In a method for coating strip which includes the steps of passing the strip through a bath of molten metal, controlling the thickness of the applied coat, heating the coated strip to the proper alloying temperature, and passing the heated alloyed strip into contact with a roll comprised of a material having good electrical conductivity and compatible with graphite and which roll is located above the bath, the improvement comprising the step of covering the exterior surface of said roll with an adherent graphite film, whereby to prevent metal pickup on the said roll.

2. The method of claim 1 in which said graphite film is obtained by wiping the said exterior roll surface with a 10% graphite colloidal suspension in mineral oil.

3. The method of claim 2 including the step of insuring that the said roll is hot enough to vaporize the said mineral oil.

4. The method of claim 3 including the step of heating the said coated strip and said roll by resistance heating, whereby to obtain a graphite film which prevents adherence of coating metal particles to the said roll and which reduces friction between the said strip and roll surface without disturbing electrical continuity between the said strip and roll.

5. The method of claim 1 in which said graphite film is obtained by wiping the said exterior roll surface with a colloidal suspension of graphite in a suitable carrier.

6. The method of claim 5 in which the said carrier is water.

7. The method of claim 5 in which the said carrier is mineral oil.

8. The method of claim 1 in which said graphite film is obtained by wiping the said exterior roll surface with a solid graphite block wiper.

9. A method for preventing alloyed coating metal pickup on a hot-dip coating line roll comprised of a material having good electrical conductivity and compatible with graphite which method includes the step of applying an adherent graphite film to cover the exterior surface of said roll.

10. The method of claim 9 in which said film is applied by the steps of wiping the said surface with a colloidal suspension of graphite in a suitable carrier, and vaporizing the carrier so as to leave naught but the said graphite film.

11. The method of claim 10 in which said carrier is mineral oil.

12. The method of claim 11 in which the suspension is 10% graphite.

13. The method of claim 10 in which said carrier is water.

14. The method of claim 9 in which said film is obtained by the step of wiping the said surface with a solid graphite block wiper.

* * * * *

UNITED STATES PATENT OFFICE

CERTIFICATE OF CORRECTION

Patent No. 3,975,556 Dated August 17, 1976

Inventor(s) Marvin B. Pierson et al. Page 1 of 2

It is certified that error appears in the above-identified patent and that said Letters Patent are hereby corrected as shown below:

On the Title page, the illustrative figure and the one sheet of drawing, should appear as shown on the attached sheet.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*

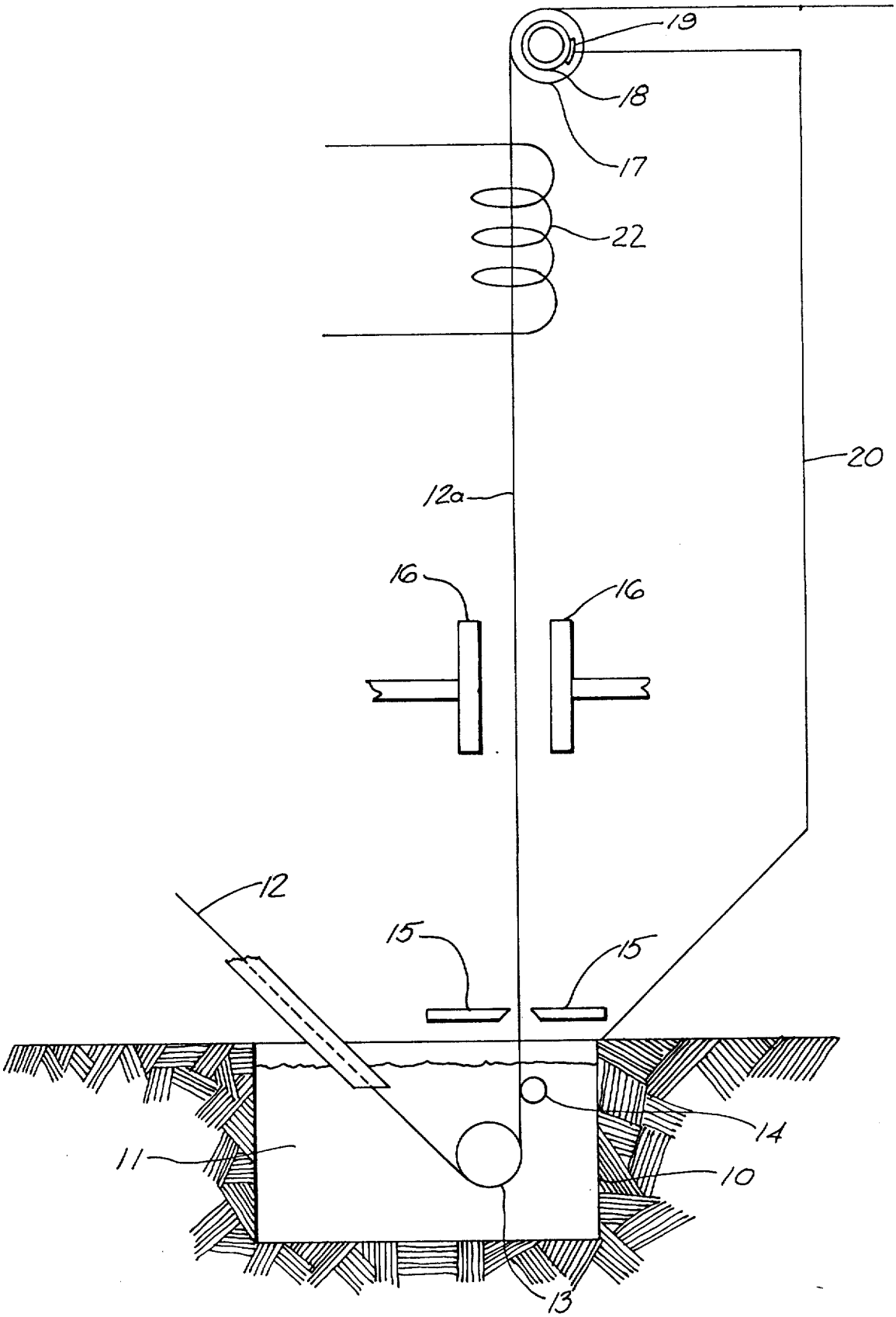
19
18
17
22
20
12a
16
16
12
15
15
14
11
10
13